US008382244B2

(12) United States Patent
Mizes

(10) Patent No.: US 8,382,244 B2
(45) Date of Patent: Feb. 26, 2013

(54) METHOD AND SYSTEM FOR ACTUATING REDUNDANT ELECTRICAL MOTORS TO MOVE PRINTHEADS LATERALLY AND IMPROVE RELIABILITY IN A CONTINUOUS WEB INKJET PRINTER

(75) Inventor: Howard A. Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 6 days.

(21) Appl. No.: 13/155,506

(22) Filed: Jun. 8, 2011

(65) Prior Publication Data

US 2012/0314001 A1 Dec. 13, 2012

(51) Int. Cl.
*B41J 2/165* (2006.01)

(52) U.S. Cl. ..... 347/40

(58) Field of Classification Search ..... None
See application file for complete search history.

(56) References Cited

U.S. PATENT DOCUMENTS

| | | | | |
|---|---|---|---|---|
| 5,838,343 | A * | 11/1998 | Chapin et al. | 347/22 |
| 6,829,565 | B2 | 12/2004 | Siegel et al. | |
| 2004/0195989 | A1 | 10/2004 | Harriman et al. | |
| 2006/0092204 | A1 * | 5/2006 | White et al. | 347/12 |
| 2009/0072083 | A1 | 3/2009 | Hanlon et al. | |
| 2010/0013882 | A1 | 1/2010 | Mizes et al. | |
| 2010/0315461 | A1 * | 12/2010 | Mongeon et al. | 347/19 |

* cited by examiner

*Primary Examiner* — Matthew Luu
*Assistant Examiner* — Alejandro Valencia
(74) *Attorney, Agent, or Firm* — Maginot, Moore & Beck, LLP

(57) ABSTRACT

A method of operating a printer enables a controller in the printer to operate electrical motors to move printheads in the printer for longer periods of time before maintenance is required. Each printhead in the printer is operatively connected to an electrical motor for movement of the printhead and the printheads are organized in groups with each group being operatively connected to an electrical motor for movement of the group. By selectively designating printheads as being moveable or fixed, electrical motors that fail to move a printhead can be taken out of operation and an electrical motor that moves the printhead group used instead to continue printing operations without requiring a service call for replacement of the failed motor.

6 Claims, 4 Drawing Sheets

METHOD AND SYSTEM FOR ACTUATING REDUNDANT ELECTRICAL MOTORS TO MOVE PRINTHEADS LATERALLY AND IMPROVE RELIABILITY IN A CONTINUOUS WEB INKJET PRINTER

TECHNICAL FIELD

This disclosure relates generally to printhead alignment in an inkjet printer having one or more printheads, and, more particularly, to the electrical motors used to align the printheads in a continuous web inkjet printer.

BACKGROUND

A typical inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

One factor affecting the registration of images printed by different groups of printheads is printhead alignment. In some printers, multiple printheads are configured to enable the printheads to print a continuous line or bar on media in a cross-process direction. Aligning the printheads so the nozzles at one end of a printhead, such as the right end of the printhead, are spaced from nozzles at the other end of another printhead, such as the left end of the printhead, by a distance that is approximately the same as adjacent nozzles within a printhead is important for registration. Printheads arranged in a column also need to be aligned to enable a second printhead in the column in the process direction to eject ink drops onto or next to ink drops ejected by a first printhead in the column.

Currently, printers include controllers that receive image data of printed test patterns and analyze that image data to identify the positions and orientations of printheads. The controllers then identify distances that the printheads can be moved to compensate for differences between the actual positions of the printheads and their expected positions. These identified distances are used to generate signals for operating actuators that move either an individual printhead or a group of printheads to correct for displacement of the printhead or printheads. In some printers, the actuators that move individual printheads are smaller and less reliable than the actuators that move groups of printheads. If one of these smaller actuators need to be replaced, the entire printing system has to be halted and the motor replaced before accurately registered printing can resume. Consequently, addressing the reliability of the actuators that enable a controller to move printheads to compensate for misalignment of printheads in a printer is important.

SUMMARY

A method of operating a printer provides backup motive power for aligning printheads in the printer. The method includes operating an electrical motor operatively connected to a first printhead in a first group of printheads in a plurality of printheads to move the printhead in the first group of printheads a first direction in a cross-process direction by a first distance identified with reference to image data of a first test pattern printed by the plurality of printheads, identifying a first position for the first printhead in the first group of printheads moved by operation of the electrical motor from image data of a second test pattern printed by the plurality of printheads, comparing the identified first position of the printhead in the first group of printheads to an expected position for the printhead that corresponds to the first distance, identifying the electrical motor operatively connected to the first printhead as a failed electrical motor in response to the identified first position failing to correspond to the expected position for the printhead, changing a designation of the first printhead from moveable to fixed to enable an electrical motor operatively connected to the first printhead group to move the first printhead by a second distance identified with reference to image data of a third test pattern printed by the plurality of printheads, and changing a designation of a second printhead in the first printhead group from fixed to moveable to enable an electrical motor operatively connected to the second printhead to move the second printhead by a distance identified for the second printhead with reference to image data of the third test pattern printed by the plurality of printheads.

A method for operating electrical motors to move printheads in a printer has been developed. The method includes designating only one printhead in each printhead group within the printer as a fixed printhead, designating remaining printheads in each printhead group within the printer as moveable printheads, changing the designation for a first printhead having a moveable designation in a printhead group to a fixed designation in response to an electrical motor operatively connected to the first printhead failing to move the first printhead an identified distance, and changing the designation for the printhead having the fixed designation before the electrical motor failure to a moveable designation in response to the moveable designation of the first printhead being changed to the fixed designation.

A printer is configured to provide backup motive power for aligning printheads in the printer. The printer includes a media transport that is configured to transport media through the printer in a process direction, a plurality of printheads configured to eject ink onto media being transported past the plurality of printheads by the media transport, the plurality of printheads being arranged in a plurality of printhead groups, a plurality of electrical motors, each printhead in the plurality of printheads being operatively connected to one electrical motor in the plurality of electrical motors and each printhead group being operatively connected to one electrical motor in the plurality of electrical motors, an imaging device mounted proximate to a portion of the media transport to generate image data corresponding to a cross-process portion of the media being transported through the printer in the process direction after the media has received ink ejected from the plurality of printheads, and a controller operatively connected to the imaging device, the plurality of electrical motors, and the plurality of printheads, the controller being configured to designate only one printhead in each printhead group within the printer as a fixed printhead, to designate remaining printheads in each printhead group within the printer as moveable printheads, to change the designation for a first printhead having the moveable designation in a printhead group to a fixed designation in response to an electrical motor operatively connected to the first printhead failing to move the first printhead an identified distance, and to change the designation for the printhead having the fixed designation before the electrical motor failure to a moveable designation in response to the moveable designation of the first printhead being changed to the fixed designation.

BRIEF DESCRIPTION OF THE DRAWINGS

The foregoing aspects and other features of a printer that is configured for reliable operation of actuators to move printheads in the printer are explained in the following description, taken in connection with the accompanying drawings.

DETAILED DESCRIPTION

Figure 3:
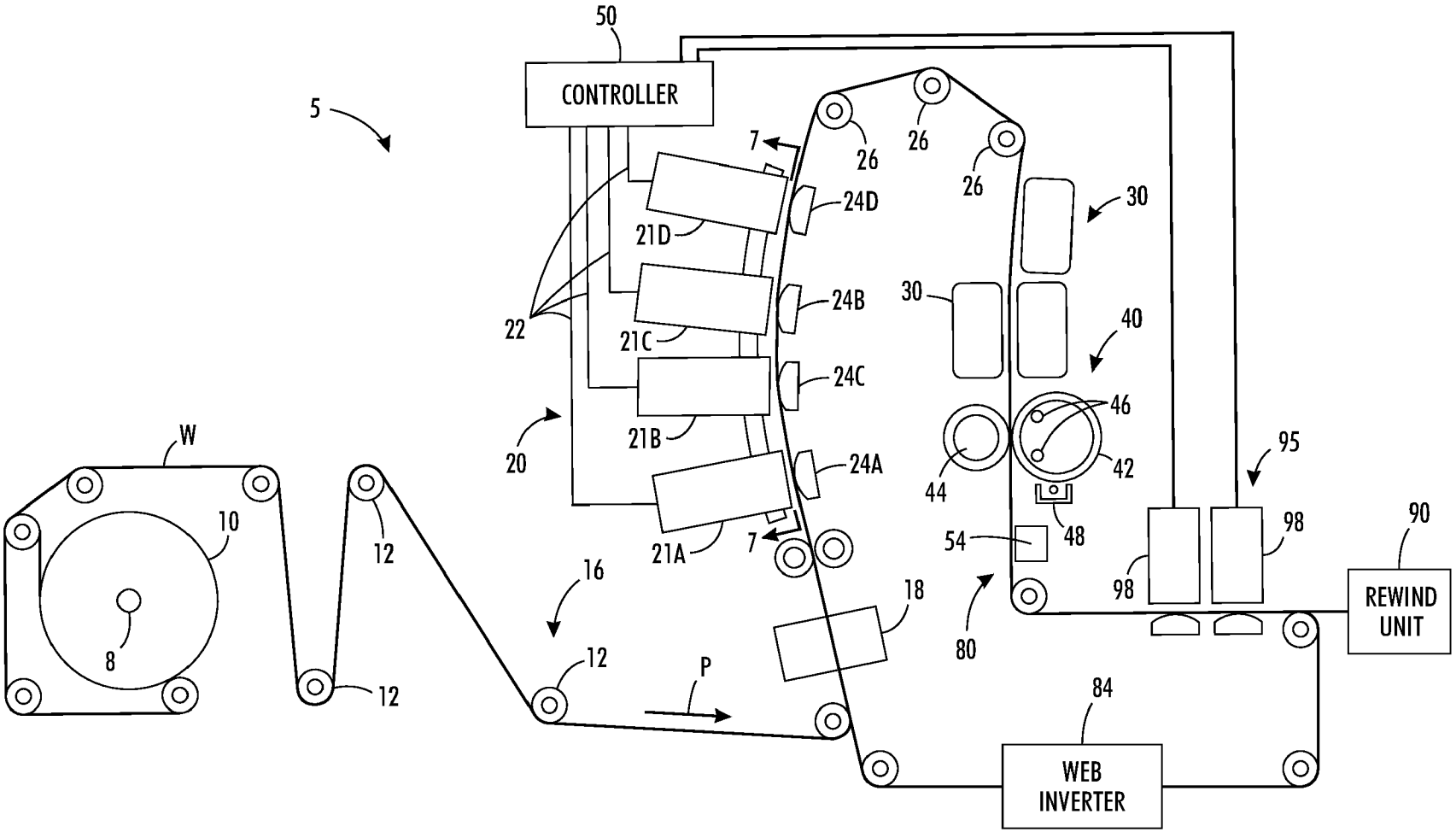
FIG. 3 is a schematic view of an improved inkjet imaging system that operates actuators that move printheads in a manner shown in FIG. 1.

Referring to FIG. 3, an inkjet imaging system 5 is shown that has been configured to provide backup actuators that are used to align printheads in the event that other actuators used to align printheads fail. For the purposes of this disclosure, the imaging apparatus is in the form of an inkjet printer that employs one or more inkjet printheads and an associated solid ink supply. The motor control described herein, however, is applicable to any of a variety of other imaging apparatuses that use electromechanical motors or other actuators to align the positions of printheads in the system.

The imaging system includes a print engine to process the image data before generating the control signals for the inkjet ejectors for ejecting colorants to form images. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

Direct-to-sheet, continuous-media, phase-change inkjet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90. Duplex operations may also be achieved with two printers arranged serially with a web inverter interposed between them. In this arrangement, the first printer forms and fixes an image on one side of a web, the inverter turns the web over, and the second printer forms and fixes an image on the second side of the web. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color stations or modules 21A, 21B, 21C, and 21D, each color station effectively extends across the width of the media and is able to eject ink directly (i.e., without use of an intermediate or offset member) onto the moving media. The arrangement of printheads in the print zone of system 5 is discussed in more detail with reference to FIG. 4. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate timing signals for actuating the inkjet ejectors in the printheads to enable the printheads to eject four colors of ink with appropriate timing and accuracy for registration of the differently color patterns to form color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a color module for each primary color may include one or more printheads; multiple printheads in an module may be formed into a single row or multiple row array; printheads of a multiple row array may be staggered; a printhead may print more than one color; or the printheads or portions thereof can be mounted movably in a direction transverse to the process direction P, also known as the cross-process direction, such as for spot-color applications and the like.

Each of the color stations 21A-21D includes multiple electrical motors configured to adjust the printheads in each of the color stations in the cross-process direction across the media web. In a typical embodiment, each motor is an electromechanical device, such as a stepper motor or the like. As used in this document, electrical motor refers to any device configured to receive an electrical signal and produce mechanical movement. Such devices include, but are not limited to, solenoids, stepper motors, linear motors, and the like. One embodiment illustrating a configuration of printhead groups, printheads, and actuators is discussed below with reference to FIG. 2.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color station is a backing member 24A-24D, typically in the form of a bar or roll, which is arranged substantially opposite the printhead on the back side of the media. Each backing member is used to position the media at a predetermined distance from the printhead opposite the backing member. As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore temperature regulating devices may be employed to maintain the media temperature within a predetermined range.

A fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 3, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40, the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5, including the actuators that move printheads, are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the electrical motor calibration function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the actuators for printhead groups and the actuators for individual printheads of color stations 21A-21D in order to adjust the positions of the printhead groups and printheads in the cross-process direction across the media web. Controller 50 is further configured to determine when an actuator for moving a printhead has failed and to operate one or more other actuators to achieve the necessary movement for a plurality of printheads to align the printheads for registration and other image quality purposes. As used in this document, "operate" with reference to an actuator, such as an electrical motor, refers to the generation and delivery of a signal to an actuator that connects the actuator to a source of energy for causing the actuator to produce movement. The actuator need not generate movement to be operated as is the case when the actuator fails to respond to the energy source.

The imaging system 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The optical imaging system may include an array of optical detectors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with respect to the signals received from unlinked portions than darker colored inks, such as black. Thus, the contrast may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

Figure 4:
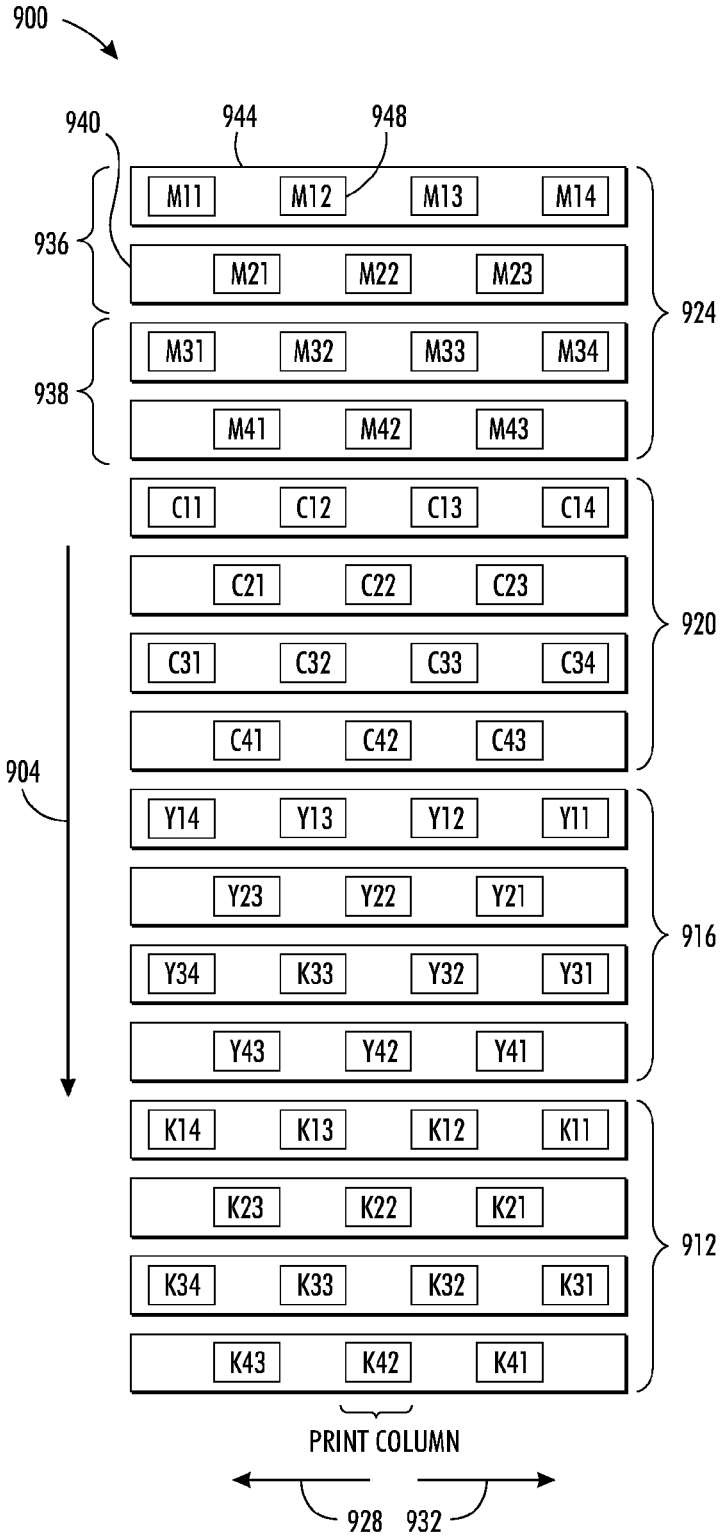
FIG. 4 PRIOR ART
FIG. 4 is a schematic view of a printhead configuration viewed along lines 7-7 in FIG. 3.

A schematic view of a prior art print zone 900 that may be used in the system 5 is depicted in FIG. 4. The printhead groups and printheads of this print zone may be moved for alignment purposes using the processes described below when the printhead groups and printheads are configured with actuators for movement of the printhead groups and printheads. The print zone 900 includes four color stations 912, 916, 920, and 924 arranged along a process direction 904. Each color station ejects ink of a color that is different than the other color stations. In one embodiment, color station 912 ejects black ink, color station 916 ejects yellow ink, color station 920 ejects cyan ink, and color station 924 ejects magenta ink. Process direction 904 is the direction that an image receiving member moves as the member travels under the color stations from color station 924 to color station 912. Each color station includes two printhead arrays, each of which include two printhead groups with each group including multiple printheads. For example, the printhead array 936 of magenta color station 924 includes two printhead groups 940 and 944. Each printhead group includes a plurality of printheads, as exemplified by the printheads on the row with printhead 948. Printhead group 940 includes three printheads, while printhead group 944 includes four printheads, but alternative embodiments of printhead groups employ a greater or lesser number of printheads. The printheads in the printhead groups within a printhead array, such as the printheads in the printhead groups 940 and 944, are staggered to provide printing across the image receiving member in the cross process direction at a first resolution. The printheads in the printhead groups of the printhead array 936 within color station 924 are interlaced with reference to the printheads in the printhead array 938 to enable printing in the colored ink across the image receiving member in the cross process direction at a second resolution. The printhead groups and printhead arrays of each color station are arranged in this manner. One printhead array in each color station is aligned with one of the printhead arrays in each of the other color stations. The other printhead arrays in the color stations are similarly aligned with one another. Thus, the aligned printhead arrays enable drop-on-drop printing of different primary colors to produce secondary colors. The interlaced printheads also enable side-by-side ink drops of different colors to extend the color gamut and hues available with the printer.

In a one embodiment, an actuator is operatively connected to a print bar on which two or more printheads are mounted to form a printhead group. The actuator is configured to reposition the printhead group by sliding the group in the cross-process direction across the media web. Printhead actuators are also connected to individual printheads within each of color stations 21A-21D for independent movement of the printheads. These printhead actuators are configured to reposition an individual printhead by sliding the printhead in the cross-process direction across the media web. In other embodiments, the printheads in a printhead group are configured for movement as a group by being components on a common printed circuit board or other structure that is operatively connected to an actuator.

Figure 2:
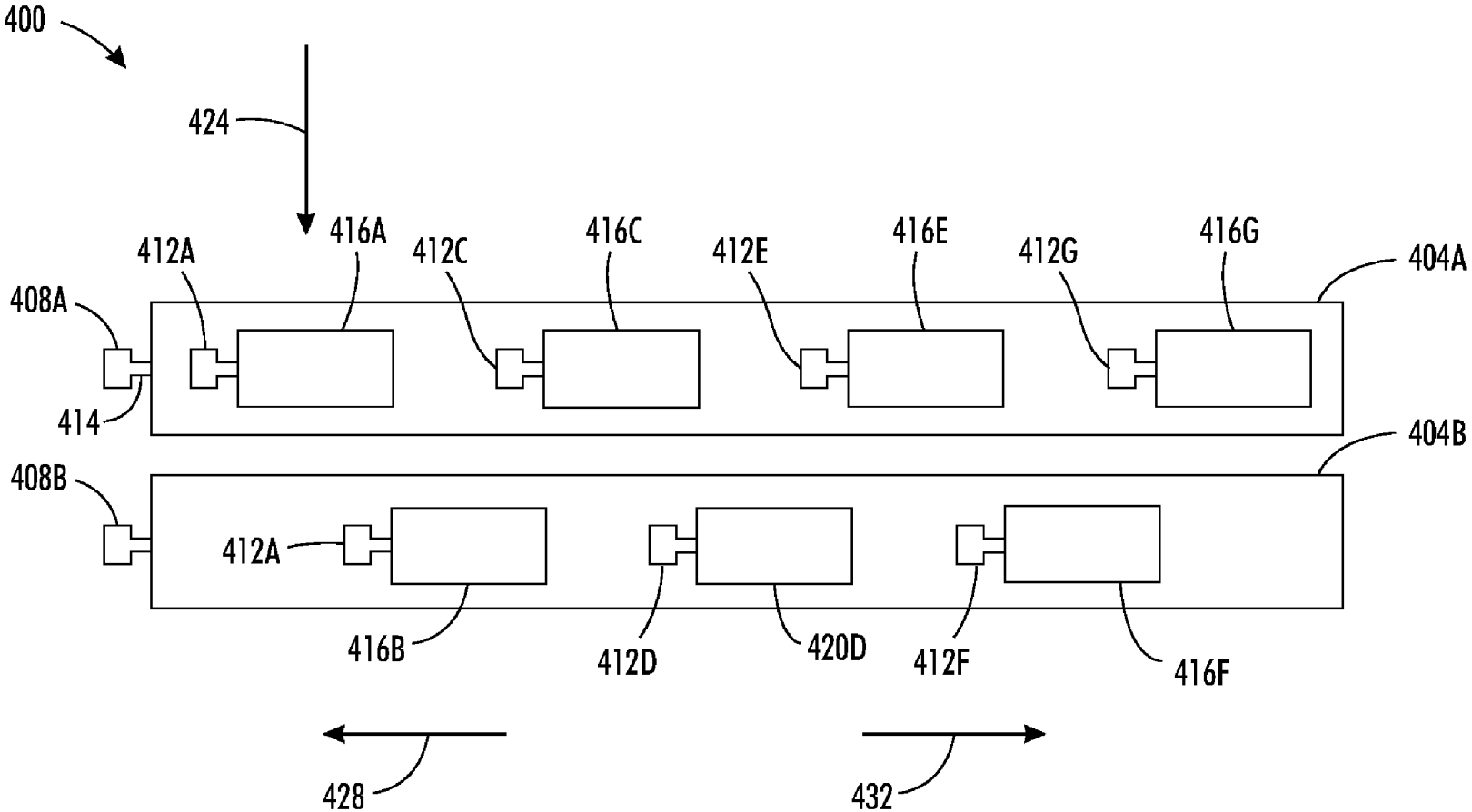
FIG. 2 is a schematic view of a plurality of printheads arranged in a pair of printhead groups.

In more detail, the printhead groups 404A and 404B in FIG. 2 are mounted to bars that are operatively connected to the electrical motors 408A and 408B, respectively. Printheads 416A-G are operatively connected to electrical motors 412A-G, respectively. Each motor 408A and 408B operatively connected to a bar moves a printhead group in either of the cross-process directions 428 or 432. Printheads 416A-416G are arranged in a staggered array to allow inkjet ejectors in the printheads to print a continuous line in the cross-process direction across a media web. Movement of a bar causes all of the printheads in a printhead group mounted to the bar to move an equal distance. Each of printhead motors 412A-412G moves an individual printhead in either of the cross-process directions 428 or 432. Motors 408A, 408B and 412A-412G are electromechanical stepper motors capable of rotating a shaft, for example shaft 414 for motor 408A, in a series of one or more discrete steps. Each step rotates the shaft a predetermined angular distance and the motors may rotate in either a clockwise or counter-clockwise direction. The rotating shafts turn drive screws that translate a bar 404A or 404B and printheads mounted to the bar along the cross-process directions 428 and 432.

The motors 408A and 408B are larger motors not subject to high temperatures. One array of printheads on a printbar may become misaligned with another array of printheads on a printbar due to small amounts of relative lateral motion of the paper between the locations of these two printbars along the web. Typically, registration is achieved by moving the set of printheads associated with the print bar with the printbar motor, rather than moving each individual head with an individual stitch motor. Therefore, an arbitrary printhead is designated as a fixed printhead and is only moved with the printbar motor. The stitch motors are then used to maintain registration across a single printbar array, while the printbar motors are typically used to maintain registration between printbar arrays.

The motors 412A-412G are commonly known as stitch motors as they move a single printhead and each end of the printhead ejects ink drops that are spatially related to ink drops ejected from at least one other printhead in the adjacent printhead group. Because these motors move only a single printhead and the space for the motors is limited, they are smaller than the motors 408A and 408B that move an entire printhead group. The smaller size of these motors and their placement in the higher temperatures of the print zones make these motors more prone to failure as they are operated frequently to maintain printhead alignment. As described herein, the measured sensitivity and backlash of an electrical motor used to move a single printhead or a printhead group is the degree to which the rotation of the motors causes translation of the printhead group and printheads along a cross-process direction across the media. The term "sensitivity" refers to the distance a printhead group or printhead moves for each step of a corresponding motor. The term "backlash" refers to the degree to which the translation imparted by a motor in a given direction is reduced because reversal of the stepper motor does not result in a translation of the print head until the shaft rotates to a position where the threads and gears between the shaft of the stepper motor and the printhead are in full contact. Thus, backlash occurs in situations where a motor moves in a first direction, and then reverses direction.

Figure 1:
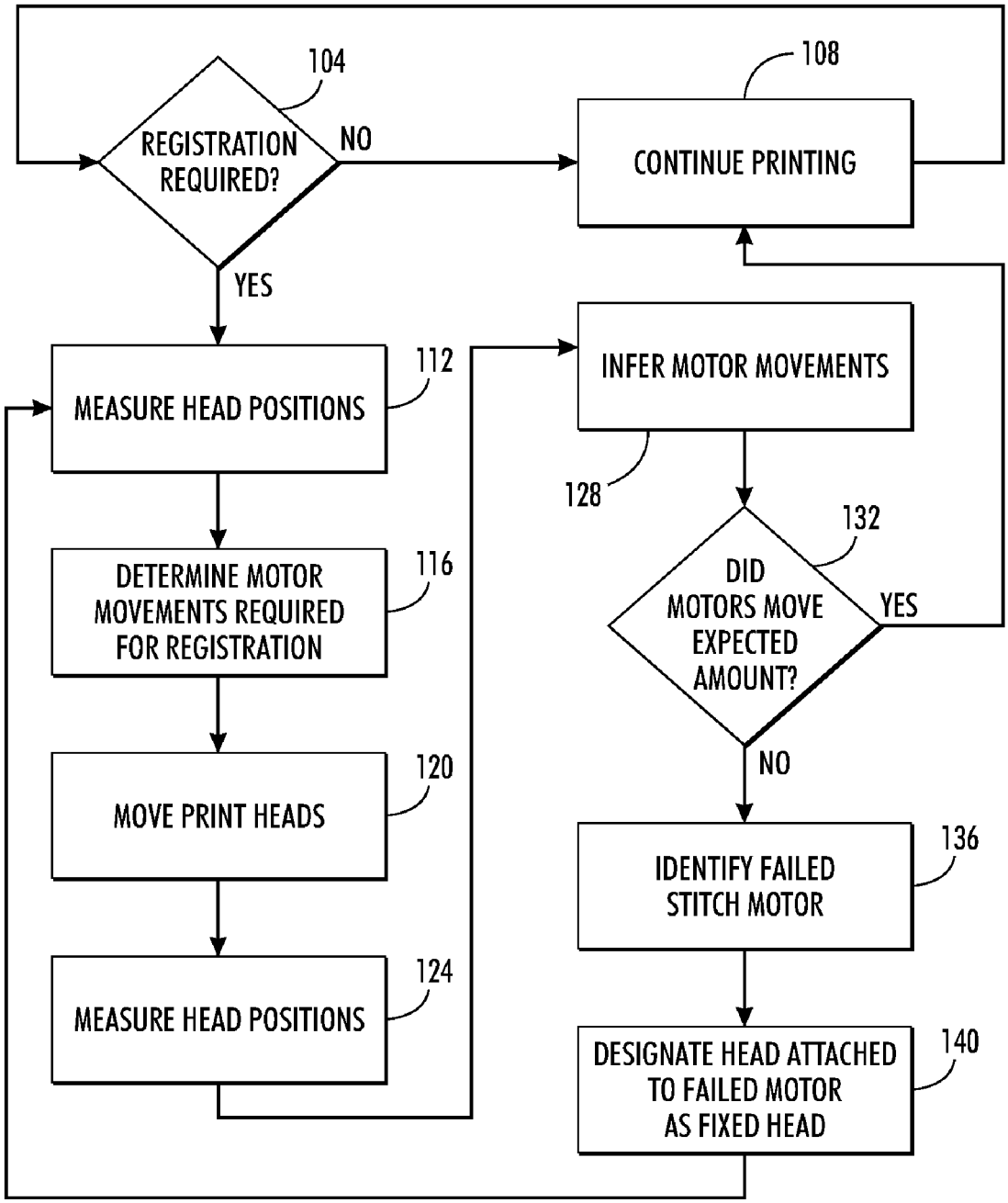
FIG. 1 is a block diagram of a process for operating actuators that move printheads in a manner that decreases the need to halt printing operations for maintenance of the actuators.

Referring to FIG. 1, a block diagram of a process 100 is shown that operates the electrical motors that move a printhead or a printhead group within a printer in a manner that provides backup motive power for moving printheads in the event of a single printhead motor failure. Process 100 begins by determining whether registration testing is required for the printer (block 104). Registration testing may occur on a periodic or other time-based basis or at the occurrence of a particular event, such as a start of a print job, the start of a new media roll, or by operator action. If no registration testing is required, printing continues (block 108). If registration testing is needed, one or more test patterns are printed, imaged, and analyzed to identify printhead positions in the printer (block 112). The identified positions of the printheads are compared to the expected positions for the printheads and printhead movement distances are identified to improve registration in the printer (block 116). These printhead movement distances are used by a controller to operate motors operatively connected to printheads and printhead groups to move each printhead a corresponding commanded distance to improve registration (block 120). One or more test patterns are then printed, imaged, and analyzed to identify the new printhead positions in the printer (block 124). The identified new positions of any printheads operatively connected to a single motor that was operated to move a printhead are compared to the expected positions for the printheads to identify the actual movement of the printhead achieved by the motor (block 128). The actual movement is compared to the commanded movement to identify those motors that failed to move the corresponding printhead by the commanded distance (block 132). If all of the motors moved the printheads to which the motors are operatively connected by the commanded amount, printing continues (block 108). Any motors that failed to move the corresponding printhead by the commanded distance are identified (block 136). In one embodiment, the commanded distance is compared to a threshold to determine whether the commanded distance is large enough to detect motor failure. If the commanded distance does not exceed the predetermined threshold, the identification of a failed motor does not occur for the motor operated to move the printhead the commanded distance. This comparison helps remove false positive determinations of failed motors because the measurement techniques are insufficiently accurate to detect movement less than the threshold amount.

Any motor identified as failing to move the printhead the commanded distance is then designated as a fixed printhead that replaces the printhead originally designated as the fixed printhead for the printhead group of which the printhead having the failed motor is a member (block 140). The printhead with the failed motor can now only be moved using the motor that moves the printhead group of which the printhead having the failed motor is a member. The process then continues to check the registration (block 112) and operate the motors to move the printheads to improve registration until the motors move the printheads and printhead groups by the appropriate amounts and registration has been adequately corrected (block 132) so printing can continue (block 108). As used in this document, "designated" or "designation" refers to one or more pieces of data associated with each printhead that indicates whether the printhead is to be moved by an electrical motor that moves only the printhead or by an electrical motor that moves the entire printhead group in which the printhead is a member. These data may be stored in a memory in association with an identifier for a printhead.

The designation of "fixed" and "moveable" for a printhead in a printhead group affects movement of the printheads for registration correction in the following way. As shown in FIG. 2, each printhead 416A-416G has a corresponding stitch motor; however, for each printhead group 404A and 404B one of the printheads in the printhead group is designated as a fixed printhead. As used in this document, "fixed" means a printhead that is moved only by operating the motor that moves the printhead group as a whole and not by operating the motor operatively connected to the printhead that moves only the printhead. Consequently, once the distances for all of the printheads in a printhead array have been identified, the motor that moves the printhead group as a whole is operated to move the printhead group by the distance identified for the fixed printhead in the group. This distance is then subtracted from the identified distances for the other printheads in the printhead group to account for the movement of the group on the identified distances for the remaining printheads in the group. For example, if a commanded distance for a fixed printhead is identified as being 60 microns to the right and a commanded distance for an adjacent printhead in the same printhead group is identified as being 20 microns to the right, then after the motor for the group is operated to move the printhead group 60 microns to the right, the motor operatively connected to the single adjacent printhead is operated to move the printhead 40 microns to the left. This movement is correct because the group movement positioned the moveable adjacent printhead 40 microns to the right past the position where the commanded distance would have placed the printhead without the group movement. Thus, the single printhead needs to move 40 microns to the left to return to that position. As used in this document, the words "identify" and "determine" include the operation of a circuit comprised of hardware, software, or a combination of hardware and software that reaches a result based on one or more measurements of physical relationships with accuracy or precision suitable for a practical application.

In operation, each printhead in each printhead group in a print zone in a printing system are designated as fixed or moveable. Only one printhead in each group can be designated a fixed printhead. Thereafter, during registration tests, the actual positions of the printheads are identified and compared to the expected positions to determine distances that are used to generate signals for operation of motors operatively connected to the printhead groups and individual printheads. The motors operatively connected to the printhead groups are used to move the group a distance corresponding to the commanded distance for the fixed printhead in the group and the moveable printheads are moved a distance that corresponds to the commanded distance for the printhead and the effect of the group move. The new positions for the printheads are then identified and compared to the expected positions to determine which, if any, individual printhead motors failed to move the corresponding printhead to the expected position. Those motors identified as having failed to operate appropriately are then designated as the fixed motor in the printhead group, the fixed motor in that group is designated a moveable motor and the registration testing process continues until the printheads are positioned as expected. This operation of the printer can continue until a second motor fails in the printhead group, in which case printing needs to halt and motor maintenance or replacement occur. Otherwise, the change in motor designation enables the printing system to continue operation without necessitating a maintenance call. Accordingly, the method and system implementing the method extend the operational life of a printing system that would otherwise be adversely impacted by single printhead motor failures.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a media transport that is configured to transport media through the printer in a process direction;

a plurality of printheads configured to eject ink onto media being transported past the plurality of printheads by the media transport, the plurality of printheads being arranged in a plurality of printhead groups;

a plurality of electrical motors, each printhead in the plurality of printheads being operatively connected to one electrical motor in the plurality of electrical motors and each printhead group being operatively connected to one electrical motor in the plurality of electrical motors;

an imaging device mounted proximate to a portion of the media transport to generate image data corresponding to a cross-process portion of the media being transported through the printer in the process direction after the media has received ink ejected from the plurality of printheads; and a controller operatively connected to the imaging device, the plurality of electrical motors, and the plurality of printheads, the controller being configured to designate only one printhead in each printhead group within the printer as a fixed printhead, to designate remaining printheads in each printhead group within the printer as moveable printheads, to change the designation for a first printhead having the moveable designation in a printhead group to a fixed designation in response to an electrical motor operatively connected to the first printhead failing to move the first printhead an identified distance, and to change the designation for the printhead having the fixed designation before the electrical motor failure to a moveable designation in response to the moveable designation of the first printhead being changed to the fixed designation.

2. The printer of claim 1, the controller being further configured to operate the electrical motor operatively connected to a printhead group to move the printhead having the fixed designation in the printhead group, and to move each printhead having a moveable designation in each printhead group by operating the electrical motor operatively connected to the printhead.

3. The printer of claim 1, the controller being further configured to operate the electrical motors to move the printheads with reference to identified positions for the printheads and expected positions for the printheads.

4. The printer of claim 3, the controller being further configured to identify positions for the printheads with reference to image data of test patterns printed by the printheads.

5. The printer of claim 1, the controller being further configured to change the designation for the first printhead in the printhead group to the fixed designation only in response to an electrical motor operatively connected to the first printhead failing to move the first printhead an identified distance and the identified distance exceeding a predetermined threshold.

6. The printer of claim 4, the controller being further configured to operate the printheads to eject ink onto media to form the test patterns, to analyze image data corresponding to the test patterns on the media to identify printhead positions, and to identify failed electrical motors in response to the identified printhead positions failing to correspond to expected positions for the printheads after the printheads have been moved by the electrical motors.

* * * * *